US006054680A

United States Patent [19]

Locher et al.

[11] Patent Number: 6,054,680

[45] Date of Patent: Apr. 25, 2000

[54] PENCIL TYPE GLOW PLUG FOR DIESEL ENGINES

[75] Inventors: Johannes Locher, Stuttgart; Albrecht Geissinger, Muehlacker; Juergen Oberle, Sindelfingen; Werner Teschner, Stuttgart; Horst Boeder, Sindelfingen; Karl-Heinz Heussner, Leonberg, all of Germany

[73] Assignee: Robert Bosch GmbH, Stuttgart, Germany

[21] Appl. No.: 08/875,211

[22] PCT Filed: Jan. 2, 1996

[86] PCT No.: PCT/DE96/00142

§ 371 Date: Nov. 3, 1997

§ 102(e) Date: Nov. 3, 1997

[87] PCT Pub. No.: WO96/27104

PCT Pub. Date: Sep. 6, 1996

[30] Foreign Application Priority Data

Feb. 28, 1995 [DE] Germany ..... 195 06 950

[51] Int. Cl.[7] ..... F23Q 7/22

[52] U.S. Cl. ..... 219/270; 219/544; 123/145 A

[58] Field of Search ..... 219/270, 544, 219/523; 73/35.12; 123/145 A

[56] References Cited

U.S. PATENT DOCUMENTS

| | | | |
|---|---|---|---|
| 4,494,401 | 1/1985 | Dobler et al. | 73/35.12 |
| 4,742,209 | 5/1988 | Minegishi et al. | 219/270 |
| 4,810,853 | 3/1989 | Maruta et al. | 219/270 |
| 4,874,923 | 10/1989 | Hatanaka et al. | 219/270 |
| 4,931,619 | 6/1990 | Ogata et al. | 219/270 |
| 4,963,717 | 10/1990 | Woelfle | 219/270 |
| 5,206,484 | 4/1993 | Issartel | 219/270 |
| 5,519,187 | 5/1996 | Hinkle | 219/270 |
| 5,589,091 | 12/1996 | Muller | 219/270 |
| 5,811,761 | 9/1998 | Kita et al. | 219/270 |

FOREIGN PATENT DOCUMENTS

| | | |
|---|---|---|
| 2755968 | 7/1978 | Germany . |
| 27 44 624 | 4/1979 | Germany . |
| 38 37 128 | 5/1989 | Germany . |

*Primary Examiner*—Mark Paschall
*Assistant Examiner*—Quang Van
*Attorney, Agent, or Firm*—Kenyon & Kenyon

[57] ABSTRACT

A sheathed type glow plug preheats the combustion chamber mixture of an auto-ignition internal combustion engine. The sheathed type glow plug comprises a ceramic heating apparatus; the resistance of the ceramic heating apparatus is increased by a reduction in cross section at the point which is most accessible to the combustion chamber mixture.

4 Claims, 2 Drawing Sheets

PENCIL TYPE GLOW PLUG FOR DIESEL ENGINES

FIELD OF THE INVENTION

The present invention relates to a glow plug for diesel engines having a ceramic heating apparatus.

BACKGROUND INFORMATION

A conventional glow plug is described in German Patent Application No. 38 37 128, in which a ceramic heating apparatus is held by the tip of a cylindrical holder. The ceramic heating apparatus is electrically insulated with respect to the holder. Provided on the end of the cylindrical holder which is opposite to the ceramic heating apparatus is a connector apparatus which makes contact to supply voltage. The ceramic heating apparatus consists of a U-shaped heating segment. The two ends of the U-shaped heating segments each make contact with the connector apparatus. During a preheat operation, a voltage is applied to the ceramic heating apparatus so that a current flows through the ceramic heating segment, specifically from one end of the U-shaped heating segment via the tip on the heating segment in the combustion chamber to the other end of the U-shaped heating segment. Due to of the resistance of the ceramic, the current causes heating of the heating segment so that the latter glows and can ignite the fuel/air mixture.

SUMMARY OF THE INVENTION

The sheathed type glow plug according to the present invention has the advantage that the region of the heating apparatus which is most accessible to the combustible mixture reaches the required ignition temperature most quickly because its resistance is thereby greater. Shorter preheat times are thus possible. The increase in resistance resulting from a reduction in the cross section of the electrically conductive ceramic makes it possible to use a ceramic heating element with greater wall thickness, which then has a reduced cross section only at the desired points, which depend on the design of the engine. The mechanical strength of, in particular, the ceramic heating segment can thereby be increased. With the defined reduction in the wall thickness, it is possible for the point on the sheathed type glow plug which is struck by the combustible mixture to be exactly that point which becomes the hottest.

It is also advantageous that by reducing the wall thickness of the ceramic heating apparatus in the side wall, an increase in resistance and thus a faster attainment of operating temperature at that point can be implemented easily and with no change in the nature of the material. When the sheathed type glow plug is installed in the swirl chamber, the point on the heating apparatus which has the best mixture accessibility is exactly the point which becomes hottest, thus resulting in better ignition of the diesel mixture.

The reduction in the cross section of the current path through the ceramic can be effected in a further simple and cost-effective manner if a known U-shaped or sleeve-shaped ceramic heating apparatus is simply equipped, at the points of the reduction in cross section, with interruptions, for example holes. This requires no new correspondingly adapted fabrication, but rather, for example, an addition of a further working step, for example drilling. Filling the electrically conductive ceramic heating apparatus with electrically insulating material increases the mechanical strength of the ceramic heating apparatus.

DETAILED DESCRIPTION OF THE INVENTION

Figure 1:
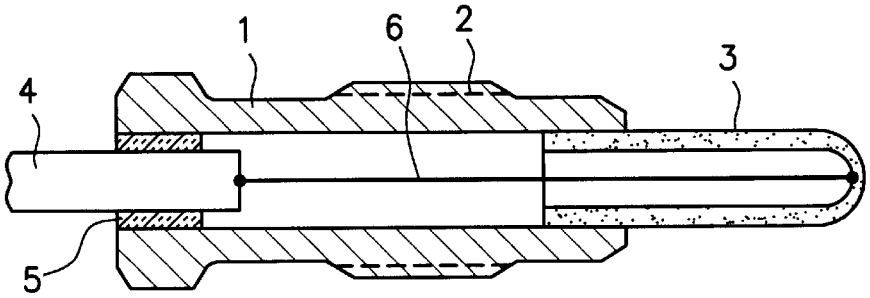
FIG. 1 shows a first embodiment of a sheathed type glow plug according to the present invention.

FIG. 1 shows a longitudinal section of a sheathed type glow plug according to a first embodiment of the present invention. The sheathed type glow plug includes a cylindrical metal tube 1. This cylindrical metal tube 1 constitutes the housing of the glow plug and serves, using threads 2 situated on the exterior, for threading into the engine block. Cylindrical metal tube 1 also serves as holder for the glow plug sheath, which projects into the combustion chamber and provides heating of the diesel mixture in the combustion chamber. Introduced into a tip of cylindrical metal tube 1, as the glow plug sheath, is a ceramic heating apparatus 3 whose head end acts as heating element. The housing is threaded, using threads 2, into the engine block (not depicted) of an internal combustion engine so that the end of ceramic heating apparatus 3 projects in cantilevered fashion into a combustion chamber of the internal combustion engine. Ceramic heating apparatus 3 is composed of, for example of an electrically conductive ceramic which has the shape of a sleeve closed at one end. A rear end of cylindrical metal tube 1 includes a connector stud 4 which is electrically insulated with respect to cylindrical metal tube 1 with an insulating layer 5. Connector stud 4 in turn makes contact, via a contact 6, with ceramic heating apparatus 3, so that electrically conductive contact is made to the contact in the closed base, at the combustion chamber end, of ceramic heating apparatus 3. Electrical contact is made from cylindrical metal tube 1 to ceramic heating apparatus 3 at its peripheral surface that is held by cylindrical metal tube, 1 so that the base, at the combustion chamber end, of ceramic heating apparatus 3 is on the one hand connected to supply voltage, which for example is supplied from the battery (not depicted) of a motor vehicle, and on the other hand makes contact to ground via cylindrical metal tube 1. A current flow thus occurs from the closed base of ceramic heating apparatus 3, via the side walls of the sleeve-shaped ceramic heating apparatus, to the cylindrical metal tube and to ground. Thus, the wall thickness of ceramic heating apparatus 3 is not the same over the entire length of ceramic heating apparatus 3. Instead, the wall thickness at the cantilevered combustion chamber end of ceramic heating apparatus 3 is less than at the rim of the sleeve-shaped ceramic heating apparatus. The resistance at the combustion chamber end of ceramic heating apparatus is thereby increased, so that the ceramic heating apparatus 3 glows first at this point. It is not, however, absolutely necessary in this context that the ceramic heating apparatus have a sleeve shape. A U-shaped ceramic heating apparatus is also possible, for example; once again, the wall thickness of the combustion chamber end of ceramic heating apparatus 3 is tapered with respect to the end of the ceramic heating apparatus secured in the cylindrical metal tube. The cross-sectional depiction of a U-shaped ceramic heating apparatus is identical to the cross-sectional depiction of a sleeve-shaped ceramic heating apparatus, so that FIG. 1 illustrates both variants.

Figure 2:
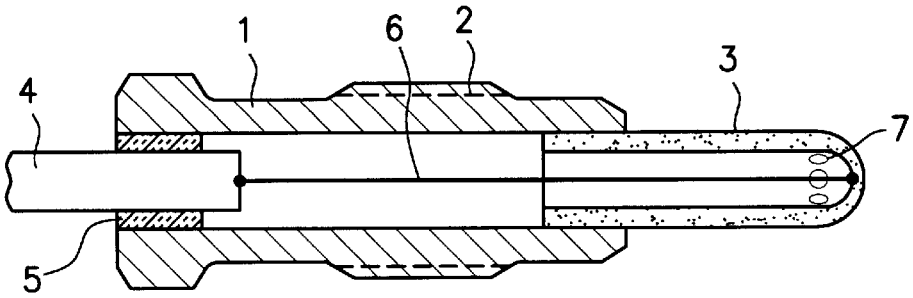
FIG. 2 shows a second embodiment of the sheathed type glow plug according to the present invention.

FIG. 2 shows the longitudinal section of a second embodiment of the glow plug according to the present invention.

The sheathed type glow plug shown in FIG. 2 corresponds in its fundamental construction to the physical configuration of FIG. 1, so that the individual details are given the same reference characters, and the configuration will not be explained again for the same details. In the case of the second embodiment shown in to FIG. 2, the cross-sectional area of ceramic heating apparatus 3 is reduced at the end remote from the holder. In contrast to FIG. 1, however, openings 7 are made in the wall of ceramic heating apparatus 3. The point of least material cross section, and therefore the hottest point on ceramic heating apparatus 3, can be precisely defined and set using a number, diameter, and location of openings 7 that are made. The basic shape of ceramic heating apparatus 3 is immaterial in this context, since these openings in the form of holes can be made in any shape, i.e. for example in U-shaped and sleeve-shaped ceramic heating apparatuses. All that is necessary is to ensure that when voltage is applied, current flows through the point in ceramic heating apparatus 3 at which the cross-sectional area for current flow is reduced, and resistance is thus increased.

The core of ceramic heating apparatus 3 is filled with a heat-resistant, electrically insulating material.

Figure 3:
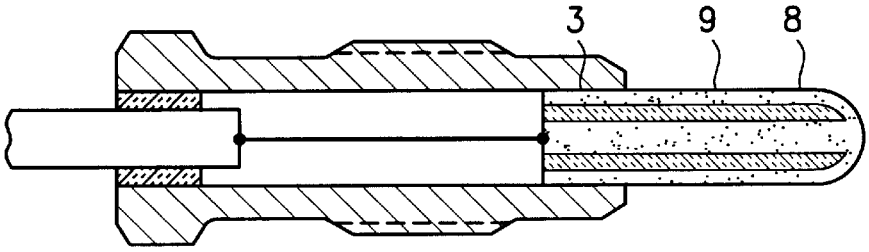
FIG. 3 shows a third embodiment of the sheathed type glow plug according to the present invention.

FIG. 3 shows a third embodiment of the glow plug according to the present invention in which the fundamental construction of the sheathed type glow plug corresponds to the construction illustrated in FIGS. 2 and 3. The only difference is in the configuration of the ceramic heating segment. The ceramic heating apparatus here is rod-shaped, with an annular recess 8 which has a concentric core 9. Annular recess 8 extends over almost the entire length of ceramic heating apparatus 3, in such a way that at the end of ceramic heating apparatus 3 remote from the housing, the cross section of the electrical ceramic is reduced in defined fashion by the fact that annular recess 8 projects far enough into the tip, remote from the holder of rod-shaped ceramic heating apparatus 3 that the cross-sectional area for the current is lowest there.

Figure 4:
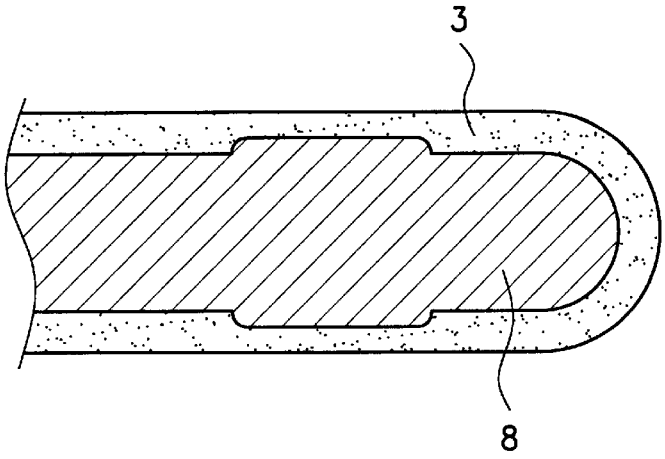
FIG. 4 shows a fourth embodiment of the sheathed type glow plug according to the present invention.
Figure 5:
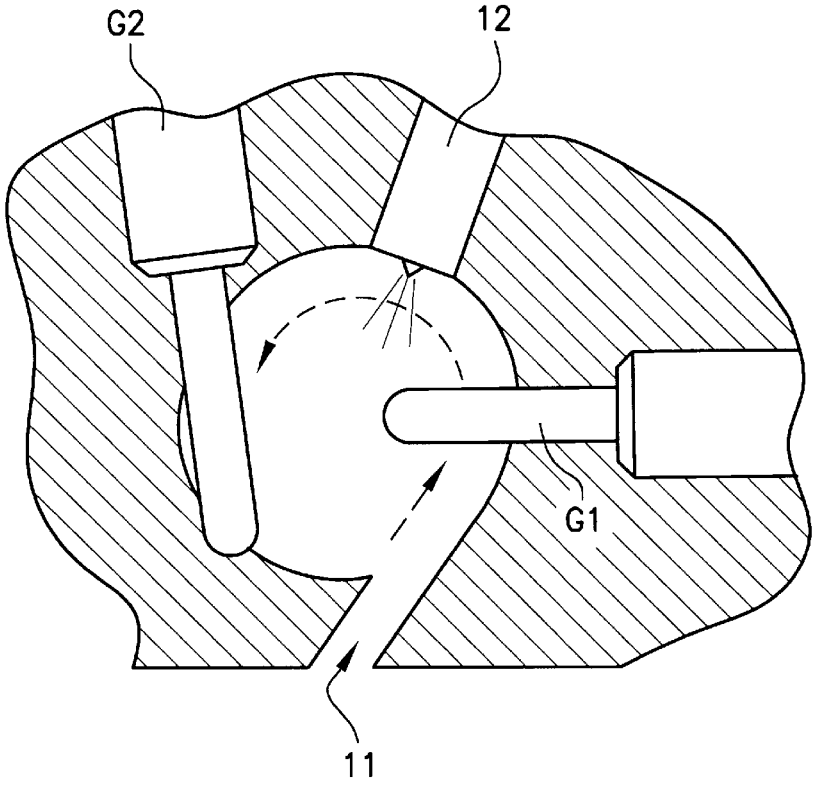
FIG. 5 shows two exemplary variant installations of the glow plug in a swirl chamber of an internal combustion engine.

FIG. 4 shows a fourth embodiment of the glow plug according to the present invention, which will be explained with reference to FIG. 5. FIG. 4 shows only the ceramic heating sheath, since the construction and arrangement of the metal tube and the connector apparatus correspond to FIGS. 1 to 3, and will not be explained again here. FIG. 5 shows a swirl chamber of an internal combustion engine. The combustion air necessary for combustion passes through an overflow duct 11 into the swirl chamber, while fuel is injected into the swirl chamber through a nozzle 12, so that a combustible mixture forms. As shown in FIG. 5, two installations are possible for sheathed type glow plugs. Sheathed type glow plug G1 is depicted here in the so-called "upflow" position, i.e. the combustion air flowing in through overflow duct 11 of the swirl chamber strikes sheathed type glow plug G1 in an upward direction. In this case the tip of the glow plug sheath remote from the holder is most accessible to the combustible mixture. It is thus advisable to provide the point with the reduction in the cross section of the electrically conductive ceramic, as described in FIGS. 1 to 3, at the tip of the ceramic heating apparatus remote from the holder. The second sheathed type glow plug G2, on the other hand, is installed in the so-called "downflow" position. In this case the inflowing combustion air strikes sheathed type glow plug G2 in a downward direction. For clarification, the flow direction in the swirl chamber has been schematically drawn in using the dashed arrow. Since, with this downflow position of the sheathed type glow plug, the combustible mixture strikes the glow plug sheath at a defined distance from the tip that is remote from the holder, the reduced cross section is also effected at that point. In this context, the defined distance depends on the design of the engine. Installation in the downflow direction is more favorable than the upflow position in terms of exhaust emissions.

The ceramic heating apparatus in the form of the glow plug sheath which is held in cantilevered fashion by the housing can, of course, also be used with flame plugs as the heating apparatus.

What is claimed is:

1. A glow plug for a diesel engine, comprising:

a ceramic heating apparatus including at least one portion having a wall thickness, wherein an area of the wall thickness is decreased to reduce a cross section of the ceramic heating apparatus, the reduced cross section of the ceramic heating apparatus being arranged within a side wall of the ceramic heating apparatus only at a predetermined striking position of a fuel-air mixture;

a connector apparatus for electrically contacting the ceramic heating apparatus so that a current flows through the ceramic heating apparatus during a preheat operation; and a cylindrical metal tube holding the ceramic heating apparatus, the cylindrical metal tube including a tip for cantileverly holding the ceramic heating apparatus.

2. A glow plug for a diesel engine, comprising:

a ceramic heating apparatus including at least one portion having a wall thickness, wherein an area of the wall thickness is decreased to reduce a cross section of the ceramic heating apparatus, the reduced cross section of the ceramic heating apparatus being arranged within a side wall of the ceramic heating apparatus at a predetermined striking point of a fuel-air mixture, wherein the reduced cross section of the ceramic heating apparatus is further reduced via openings in the side walls of the ceramic heating apparatus;

a connector apparatus for electrically contacting the ceramic heating apparatus so that a current flows through the ceramic heating apparatus during a preheat operation: and a cylindrical metal tube holding the ceramic heating apparatus, the cylindrical metal tube including a tip for cantileverly holding the ceramic heating apparatus.

3. The glow plug according to claim 1, wherein the ceramic heating apparatus is filled with a heat-resistant electrically-insulating material.

4. A glow plug for a diesel engine, comprising:

a cylindrical metal tube holder;

a ceramic heating apparatus, the cylindrical metal tube including a tip for cantileverly holding the ceramic heating apparatus, the ceramic heating apparatus having a wall thickness, wherein an area of the wall thickness is decreased to reduce a cross section of the ceramic heating apparatus, the reduced cross section of the ceramic heating apparatus being arranged within a side wall of the ceramic heating apparatus at a predetermined striking point of a fuel-air mixture, wherein the predetermined striking point is at a defined distance from a tip of the ceramic heating apparatus remote from the holder; and a connector for electrically contacting the ceramic heating apparatus so that a current flows through the ceramic heating apparatus during a preheat operation.

* * * * *